US007832454B2

(12) United States Patent
Lyons

(10) Patent No.: US 7,832,454 B2
(45) Date of Patent: Nov. 16, 2010

(54) SCREEN ENCLOSURE PRIVACY SYSTEM

(76) Inventor: Scott L. Lyons, 6727 Stephens Path, Zephyrhills, FL (US) 33542

( * ) Notice: Subject to any disclaimer, the term of this patent is extended or adjusted under 35 U.S.C. 154(b) by 429 days.

(21) Appl. No.: 11/876,352

(22) Filed: Oct. 22, 2007

(65) Prior Publication Data

US 2008/0128671 A1 Jun. 5, 2008

Related U.S. Application Data

(60) Provisional application No. 60/862,586, filed on Oct. 23, 2006.

(51) Int. Cl.
*E06B 9/00* (2006.01)

(52) U.S. Cl. ..... 160/368.1; 160/349.1

(58) Field of Classification Search ..... 160/369, 160/368.1, 349.1, 349.2, 345; 16/94 D, 95 D, 16/96 D See application file for complete search history.

(56) References Cited

U.S. PATENT DOCUMENTS

| | | | | | |
|---|---|---|---|---|---|
| 3,143,165 | A | * | 8/1964 | Lewis et al. | 160/394 |
| 3,222,841 | A | * | 12/1965 | Lipof | 52/482 |
| 3,278,980 | A | * | 10/1966 | Donovan | 16/94 D |
| 3,382,639 | A | * | 5/1968 | Smith et al. | 52/844 |
| 3,698,034 | A | * | 10/1972 | Endou et al. | 16/87.4 R |
| 3,808,610 | A | * | 5/1974 | Mortensen | 4/558 |
| 3,883,924 | A | * | 5/1975 | Grabman | 16/94 D |
| 4,100,957 | A | * | 7/1978 | Shelton | 160/368.1 |
| 4,166,494 | A | | 9/1979 | Utting | |
| 4,437,505 | A | * | 3/1984 | Rodgers | 160/126 |
| 4,679,609 | A | * | 7/1987 | Bateman | 160/124 |
| 4,765,022 | A | * | 8/1988 | Siegal et al. | 16/87.4 R |
| 4,770,224 | A | * | 9/1988 | Dubbelman | 160/331 |
| 5,271,449 | A | * | 12/1993 | Herrick | 160/368.1 |
| 5,323,835 | A | * | 6/1994 | Bachmeier | 160/89 |
| 5,358,025 | A | * | 10/1994 | Wood | 160/368.1 |
| 5,427,169 | A | * | 6/1995 | Saulters | 160/368.1 |
| 5,680,893 | A | | 10/1997 | Neer | |
| 5,908,179 | A | * | 6/1999 | Fimbres | 248/51 |
| 6,209,614 | B1 | * | 4/2001 | Smoot | 160/237 |
| 2004/0221973 | A1 | * | 11/2004 | Hesse | 160/368.1 |

* cited by examiner

*Primary Examiner*—David Purol
(74) *Attorney, Agent, or Firm*—John L. DeAngelis; Beusse Wolter Sanks Mora & Maire, P.A.

(57) ABSTRACT

One embodiment of the present invention comprises a privacy system for use with an existing screen enclosure enclosing an area where privacy is desired. The screen enclosure includes vertical members attached to upper horizontal members to form a screen enclosure frame and a screen attached to the horizontal and vertical members. The privacy system comprises a substantially horizontal support member attached to the vertical members of the screen enclosure; a channel along a lower surface of the horizontal support member, the channel comprising stop elements at open ends of the channel; a plurality of fasteners having a first end slidably engaged with the channel, the stop dements cooperating with the channel to retain fasteners within the channel; a valence affixed to a surface of the support, the surface feeing toward an interior region of the enclosed area; and illumination devices attached to the tower surface of the horizontal support member between the valence and the privacy screen.

16 Claims, 6 Drawing Sheets

SCREEN ENCLOSURE PRIVACY SYSTEM

The present application claims the benefit under Section 119(e) of the provisional application filed on Oct. 23, 2006, and assigned application No. 60/862,586.

FIELD OF THE INVENTION

The present invention relates to a screen enclosure privacy system, more specifically, but not by way of limitation, to a screen enclosure privacy system affixed to a screen enclosure to inhibit viewing of individuals and objects inside the screen enclosure from vantage points outside the screen enclosure.

BACKGROUND OF THE INVENTION

Homes with swimming pools are required to have a fence surrounding the home site or a screen enclosure surrounding the pool. These barriers prevent uninvited people, especially young children, from gaining access to the pool and potentially sustaining a consequent injury. Homeowners typically prefer a screen enclosure. Also, many communities prohibit home site fences to maintain an unobstructed neighborhood view.

Homeowners employing a screen enclosure frequently encounter privacy issues, for those enjoying the pool. many desire a modicum of privacy in their pool area, but with the size of today's home sites shrinking, neighbors can easily see inside the screen enclosure and the sense of privacy is comprised. View blocks comprising landscape buffers surrounding the screen enclosure are an aesthetically pleasing alternative solution, but the vegetation requires an extended time to grow to a height and thickness to effectively block the view of onlookers, both innocent and purposeful, Also, the vegetation must be trimmed and pruned during the growing season.

BRIEF DESCRIPTION OF THE DRAWINGS

The foregoing and other features of the invention will be apparent from the following more particular description of the invention, as Illustrated in the accompanying drawings in which like reference characters refer to the same elements throughout the different figures. The figures are not necessarily to scale, emphasis instead being placed upon illustrating the principles of the invention.

DETAILED DESCRIPTION OF THE INVENTION

Before describing screen enclosure privacy system embodiments of the present invention, it should be observed that the specification describes and the drawings illustrate only those details that are pertinent to understanding the present invention without obscuring the disclosure with structural and functional details that will be apparent to those skilled in the art having the benefit of the description herein. Those skilled in the art will recognize that numerous different materials and structural shapes can be used as elements of the invention, without departing from the spirit and scope of the invention.

The following embodiments are not intended to define limits of the structure, function or method of the invention embodiments, but only to provide exemplary constructions. The embodiments are permissive rather than mandatory and illustrative rattier than exhaustive. The present invention may be used to provide privacy to users of a swimming pool, patio, porch or lanai.

Figure 1:
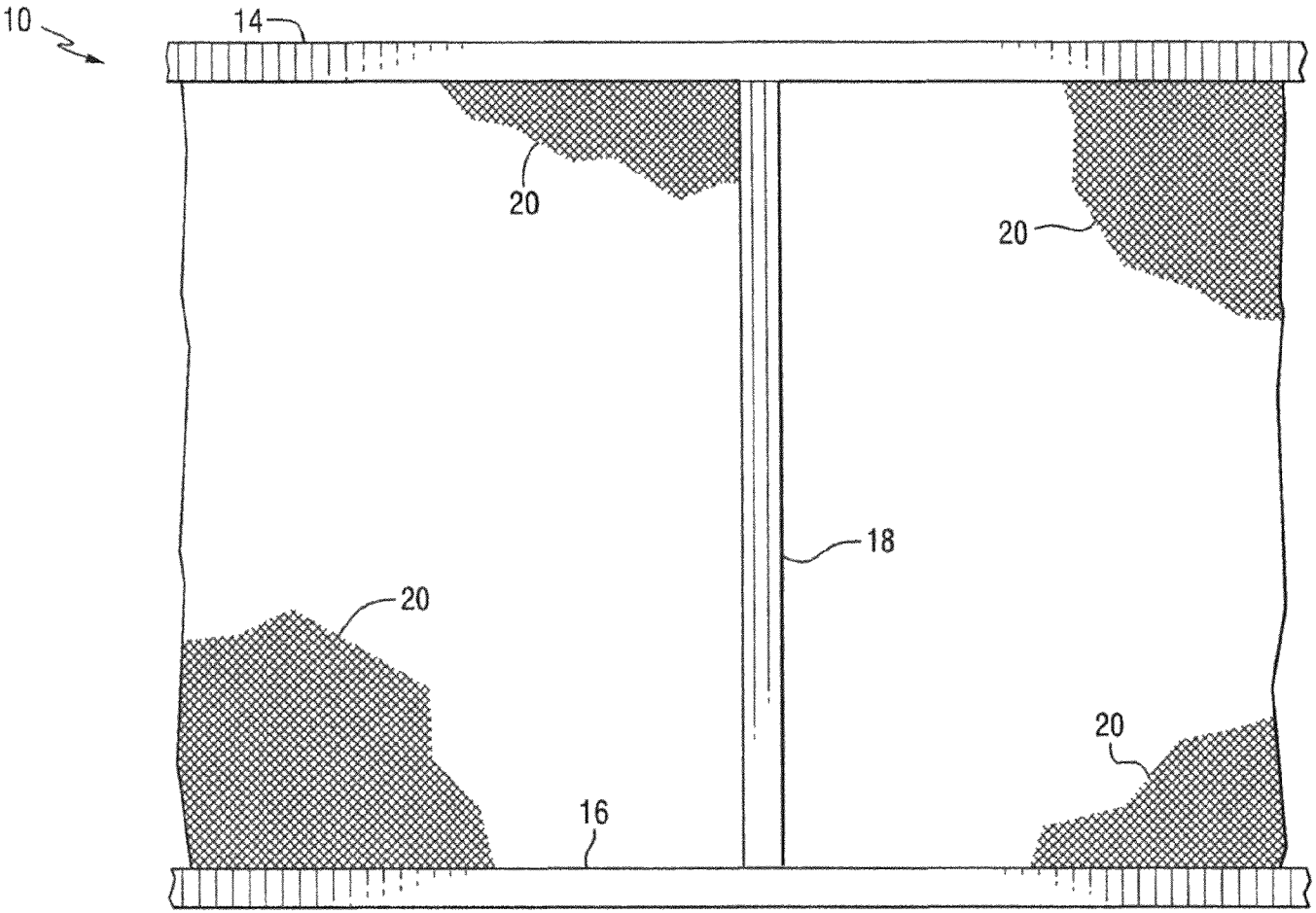
FIG. 1 PRIOR ART
FIG. 1 illustrates a section of a prior art screen enclosure for use with the screen enclosure privacy system of the present invention.

FIG. 1 illustrates a portion 10 of an exemplary prior art screen enclosure (or pool cage) surrounding a swimming pool (not shown) or enclosing an area adjacent a structure (not shown). The portion 10 comprises an upper horizontal member 14, a lower horizontal member 16 attached to a deck surface and a vertical member 18 connecting the upper and lower horizontal members 14 and 16. Alternatively, the lower horizontal member 16 attaches only to the vertical member 18 and not to the deck surface.

Screen panels 20 attach to the upper and lower horizontal members 14 and 16 and to the vertical member 18 according to well known techniques. Since the swimming pool is typically located immediately adjacent a porch extending from a house, a section of the upper horizontal member 14 may be affixed to a sidewall of the house or to a vertical surface of the roof. To ensure the screen enclosure can withstand the various forces and wind loads imposed on it, the enclosure commonly comprises braces and support members not shown in FIG. 1. A material of the members 14, 16 and 18 may comprise aluminum or an aluminum alloy.

Figure 2:
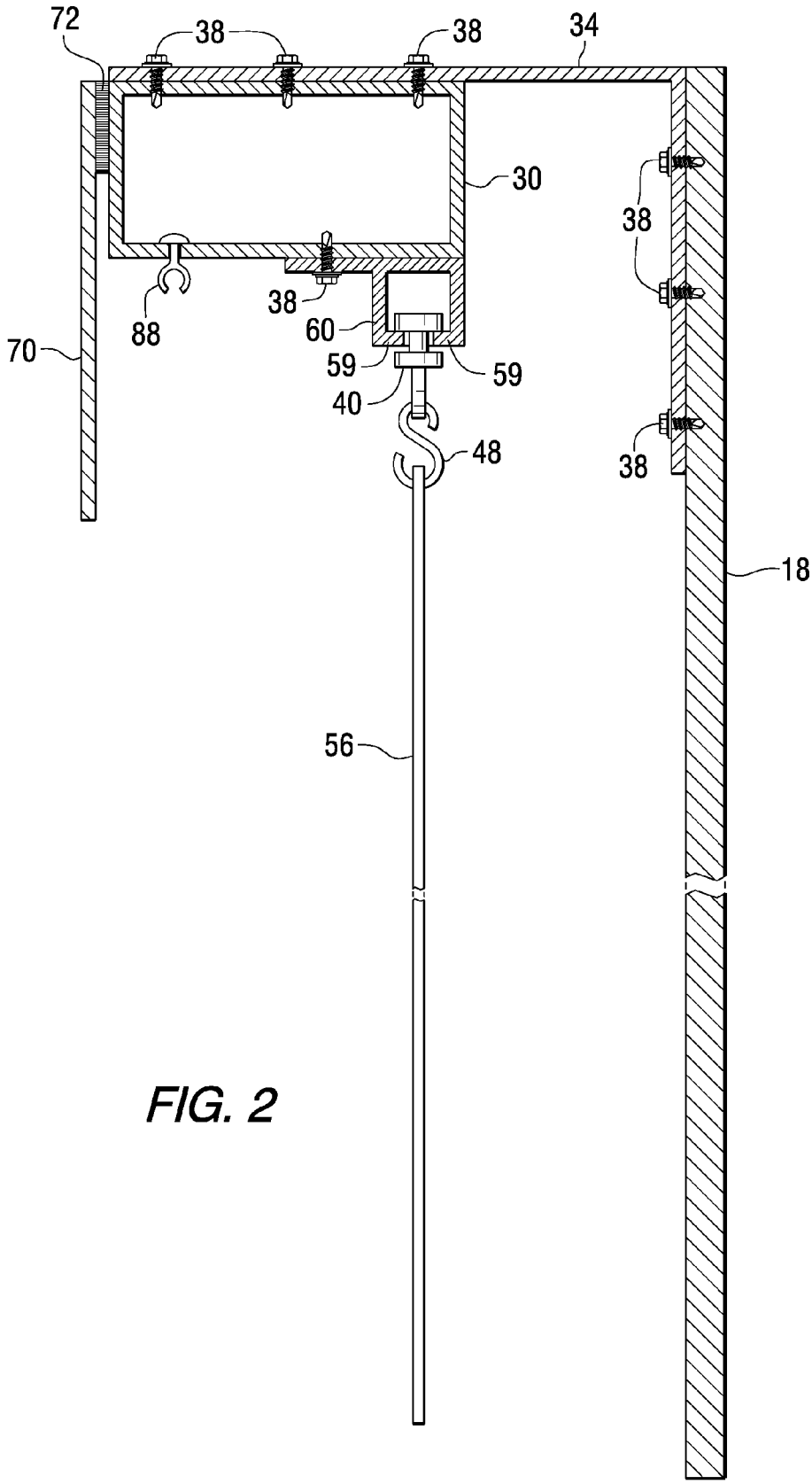
FIG. 2 illustrates a side view of screen enclosure privacy system elements according to the teachings of the present invention.

FIG. 2 is a side view of a support member 30 of a screen enclosure privacy system according to the present invention. The support member 30 is secured, in a generally horizontal orientation, to the existing screen enclosure (a portion 10 illustrated in FIG. 1) using suitable mechanical elements or chemical methods such as but not limited to screws, in a preferred embodiment the support member 30 is affixed to a first leg of an angle member 34 having a second leg mounted to an inwardly-facing surface of the vertical beam 18 (i.e., the surface of the vertical beam 18 that faces the inside area of the screen enclosure or the area enclosed by tie screen enclosure) as illustrated. In the illustrated embodiment, screws 38 (preferably self-tapping screws) attach the support member 30 to the first leg of the angle member 34 and the second leg thereof to the vertical beam 18. In a preferred installation the support member 30 extends along the perimeter of the screen enclosure to support a privacy screen disposed along all surfaces of the screen enclosure.

It is contemplated within the scope of the invention that numerous different types of brackets and other structural members can be utilized to directly or indirectly secure the support member 30 to the vertical beam 18. In one embodiment the first and second legs of the angle member 34 (having a general "L" shape) can be adjustably lengthened or shortened. In another embodiment the support member 30 is secured directly to the upper horizontal member 14 without use of the angle member 34. The support member 30 and the angle member 34 are manufactured from suitably durable and lightweight rigid material such as but not limited to aluminum or an aluminum alloy.

Figure 3:
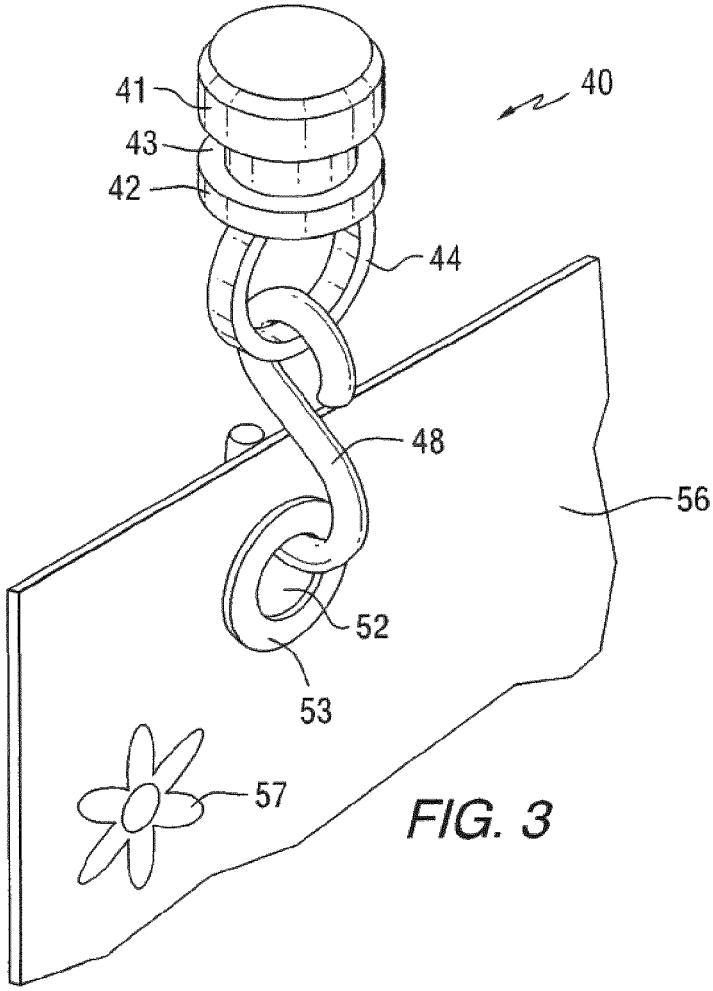
FIG. 3 illustrates certain attachment elements of one embodiment of the screen enclosure privacy system of tie present invention.

A fastener 40 illustrated in detail in FIG. 3 comprises unitary and spaced-apart generally parallel discs 41 and 42 forming a notch 43 therebetween. A ring 44 is affixed to the lower disc 42. Each fastener ring 44 supports a hook 48 that engages an opening 52 defined in an upper region of a privacy screen panel 56. The upper region may be reinforced to provide additional strength and each opening 52 may be encircled by a grommet 53, a metal ring that prevents the fastener from tearing the panel. The upper region of the privacy screen 56 defines a plurality of such openings 52 such that the privacy screen panel 56 is maintained in a vertical position by a plurality of hook/fastener combinations with the notch 43 of the fastener 40 riding in a track of the support member 30 as described below.

Returning to FIG. 2, the notch 43 of each fastener 40 slidably engages with oppositely disposed lips 59 of a channel 60 defined within the support member 30, facilitating horizontal movement of the fasteners 40 (and thus the privacy screen panel carried by the fasteners 40) along the support member 30. Thus the fasteners 40 slidably secure the privacy screen panel 56 within the channel 60 to facilitate an open or a drawn condition for the privacy screen panel 56 (and the other panels of the privacy system) as desired by the user. Stop elements are inserted at each open end of the channel 60 to prevent the fasteners 40 from sliding out of the channel 60. In one embodiment the stop element comprises a screw driven into the channel 60 at each channel open end.

FIG. 3 also illustrates a graphical image 57 affixed to or incorporated within the privacy screen panel 56.

The present invention further contemplates other methods and structural elements for opening and closing the privacy screen panels 56, such as a drawstring disposed within the channel 60 and secured to the fasteners 40. The user grasps the drawstring to horizontally traverse the fasteners 40 and the privacy screen panels 56 within the channel 60. The privacy screen panels 56 are deployed to an opened condition or to a closed condition by conventional drawstring techniques.

The openings or apertures 52 are disposed along an upper edge of the privacy screen panel 56 proximate the support member 30 to allow insertion of one of the hooks 43 therethrough. It is contemplated within the scope of the present invention that numerous suitable mechanical or chemical methods can be utilized to secure the fasteners proximate an edge of the privacy screen panels.

Those skilled in the art will also recognize that numerous different fasteners can be used to mount the privacy screen panels to the support beam while providing for horizontal traversal of the privacy screen panels to an opened or a closed position. It is further contemplated within the scope of the present invention to construct the fasteners of a suitable durable material mat is resistant to corrosion.

Figure 6:
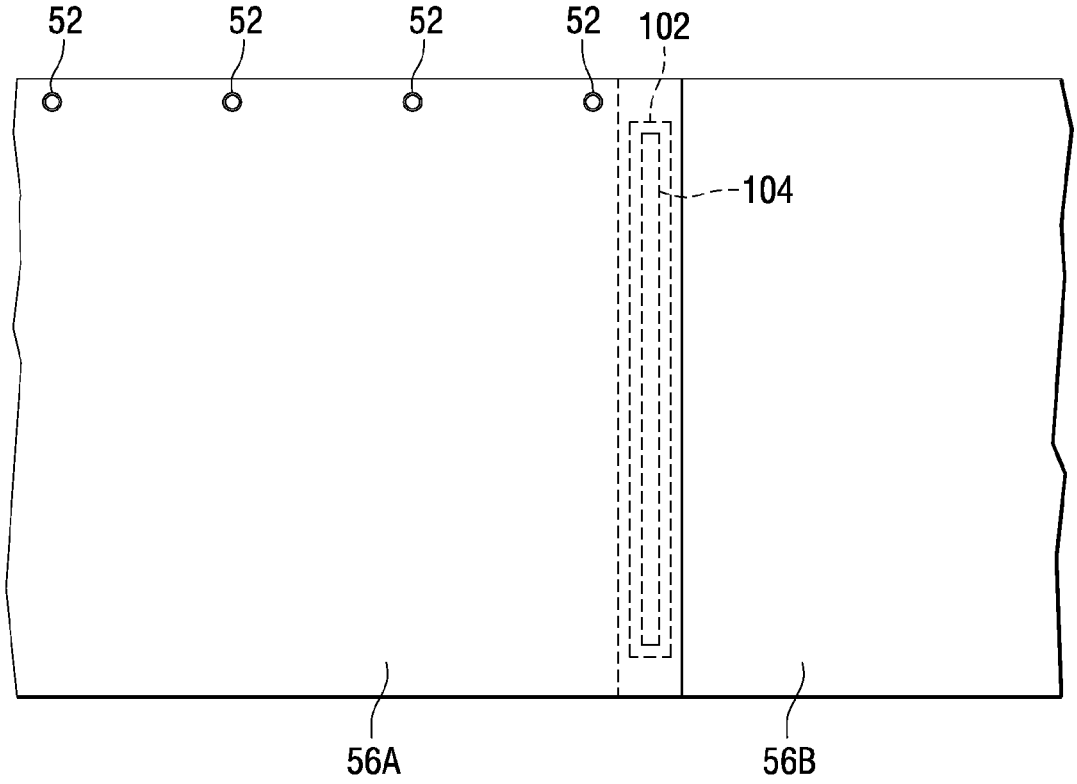
FIG. 6 illustrates elements for attaching a first privacy screen panel to a second adjacent privacy screen panel according to one embodiment of the present invention.

The privacy screen 56 is generally rectangular in shape and manufactured from a suitably durable and flexible material or fabric such as but not limited to an opaque fabric material, a furniture-grade fabric, a canvas or a marine canvas. The privacy screen is non-transparent to completely inhibit viewing of objects and people within the screen enclosure. It is further contemplated within the scope of the present invention that the privacy screen panels are manufactured from a material resistant to ultraviolet light, mildew growth and moisture. Those skilled in the art will recognize that the privacy screen panels can be manufactured in numerous different colors or further to include a plurality of designs to enhance the aesthetic appearance of the privacy screen panels. White no particular size is required, each privacy screen panel is constructed to be of a suitable size to allow a plurality of such panels to cover the sidewalls of a conventional pod screen enclosure. Although the figures depict a single panel of a screen enclosure privacy system (FIG. 6 depicts two panels), it is further contemplated within the scope of the present invention that the screen enclosure privacy system may be constructed from multiple privacy screen panels.

A valance 70 is attached to the support member 30 as further illustrated in FIG. 2. The valance 70 provides an aesthetically pleasing cover over foe support member 30 and the various structural dements affixed thereto. According to one embodiment the valence 70 is manufactured from a material similar to or identical to the material of the privacy screen 56. The valence 70 attaches to the support member 30 with a commonly available hook and loop fastening system 72, with a hook strip attached to either the support member 30 or the valence 70 and the loop system attached to the other component.

To retain a lower edge of the privacy screen panel 56 in a desired position adjacent one of the screen panels 20 or the lower horizontal member 16 (both illustrated in FIG. 1) a plurality of first attachment mechanisms are disposed along a lower edge of the panel 56, where the lower edge is opposite the support member 30. Each one of the first attachment mechanisms is tied or mated with a second attachment mechanism affixed to the lower horizontal member 16 or to the floor surface of the enclosed area. Mating the first and second attachment mechanisms releasably secures the lower edge of the privacy screen 56 for increased privacy, stability (against wind loads) and rigidity when the privacy screen 56 is in its deployed state.

In a screen enclosure privacy system comprising several serial privacy screen panels extending a length of the screen enclosure, the second attachment mechanism may be disposed proximate a joint between a first and a second adjacent privacy screen panel.

In one embodiment each ore of the first attachment mechanisms comprises a first strap segment 80 (see FIG. 5) further comprising hook members continuous with a second strap segment 82 further comprising loop members. The second attachment mechanism comprises a cleat 84 attached to the tower horizontal member 16 or the floor surface enclosed by the screen enclosure. The first strap segment 80 is threaded through the cleat 84 and attached to the second strap segment 82. Typically the cleats 84 are spaced about eight feet apart. In other embodiments snaps or other suitable fasteners may be used in lieu thereof to releasably secure the lower edge of the privacy screen 56 to the tower horizontal member 14 or to the floor surface.

Figure 5:
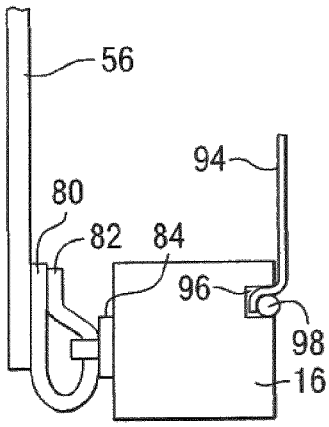
FIG. 5 illustrates certain attachment elements for a lower edge of the screen enclosure privacy system according to one embodiment of the present invention.

FIG. 5 also illustrates portions of the screen enclosure including a screen portion 94 attached to the tower horizontal member 16 by inserting an edge of the screen 94 into a channel 96 in the member 16 and installing a spline 98 into the channel 96 over the screen 94, retaining the screen edge in the channel 96.

In an installation where one or more sides of the screen enclosure are too long to cover with a single privacy screen panel, a plurality of privacy screen panels are installed end-to-end to cover the side. As illustrated in FIG. 6, a privacy screen panel 56A is attached to an adjacent privacy screen panel 56B by a fastening technique, including, but not limited to, a zipper, a hook and loop fastener system or a plurality of snaps. FIG. 6 illustrates a hook and loop fastener system comprising a loop element 102 attached to an outwardly-facing side surface of the panel 56A mated with a hook element 104 attached to an inwardly-facing side surface of the panel 56B. Two adjacent privacy screen panels meeting at a corner of the screen enclosure are similarly releasably attached.

One embodiment of the privacy screen system further comprise a string of lights (also referred as rope fighting) attached to the support member 30 between a plane of the valence 70 and a plane of the privacy screen 56 to offer a pleasant lighting effect within the enclosed area during the evening hours. Preferably a plurality of spaced apart clips 88 (see FIG. 2) are inserted into a lower surface of the support member 30 and the string of lights affixed to the dips 88. The valence 70 obscures the string of lights and file clips 88 from direct view by someone within tie screen enclosed area, while the illumination provided by the string of lights illuminates the interior of the screen enclosed area.

Figure 4:
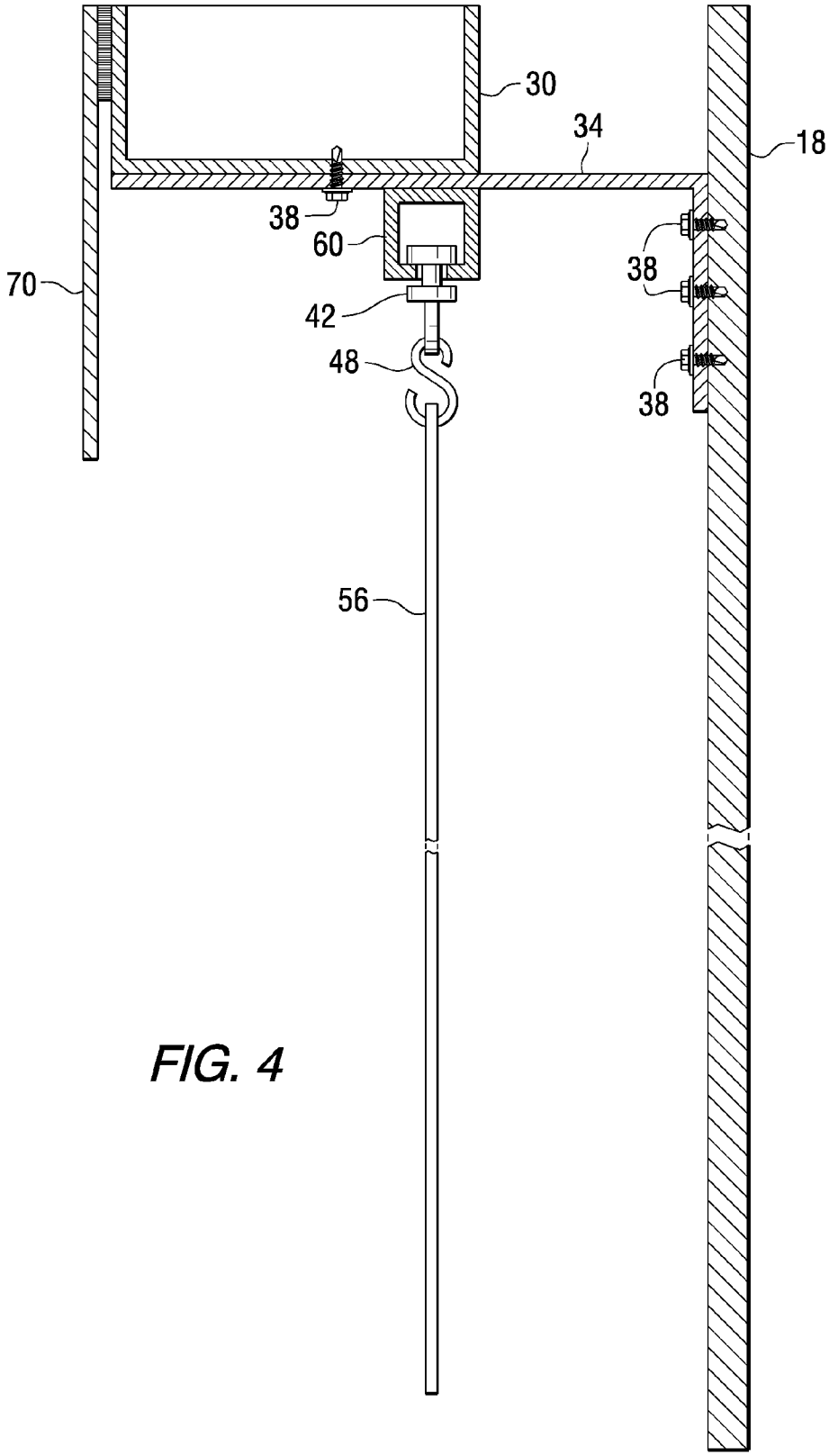
FIG. 4 illustrates certain attachment elements of an alternative embodiment of the screen enclosure privacy system.

FIG. 4 illustrates an alternative installation embodiment where the bracket 34 is mounted to a bottom surface of the support member 30 and to the vertical beam 18. This embodiment may be preferable where there is insufficient clearance between the top surface of the support member 30 and the screen enclosure roof to permit installation of the screws 38 for attaching the bracket 34 to the top surface of the support member 30. In this installation embodiment the channel 60 is distorted slightly downwardly from the bottom surface of the support member 30 as the channel 60 crosses each bracket 34, It has been observed that when the brackets 34 are spaced about six to eight feet apart, the distortion of the channel 60 does not affect operation of the screen enclosure privacy system of the present invention. Note that the clips 88 are not shown in FIG. 4 as the illustrated cross-section is not in a plane crossing a clip 88.

Figure 7:
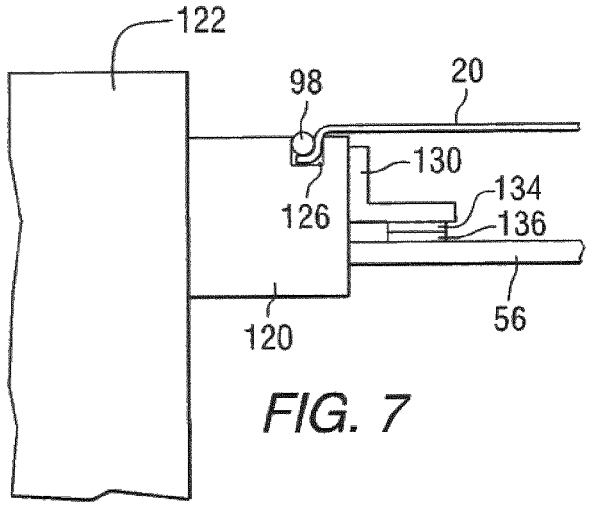
FIG. 7 illustrates elements for attaching an end region of a privacy screen to the screen enclosure according to a first embodiment of the invention.

FIG. 7 illustrates releasable support of an end region of the privacy screen panel 56 to a screen enclosure vertical beam 120 further attached to a structure 122. As illustrated, the screen portion 20 is attached to the vertical beam 120 by inserting an edge of fie screen portion 20 into a channel 126 in the vertical beam 120 and installing a spline 98 into the channel over the screen edge. An angle bracket 130 is attached to the vertical beam 120 by conventional techniques.

A first element 134 of a hook and loop attachment system is affixed to the angle bracket 130 and a second element 136 thereof is affixed to an outward-facing surface of the privacy screen 56. By mating the first and second elements 134 and 136, the privacy screen 56 is attached to the angle bracket 130 to hold the privacy screen 56 in place, completely enclosing the screen enclosure and avoiding gaps in the screen enclosure privacy system.

In one embodiment a fastening system both secures two adjacent privacy screen panels together and secures the panels to the lower horizontal member 16. Those skilled in the art will recognize that numerous materials could be utilized to manufacture structural elements to achieve the desired functionality as described herein.

Figure 8:
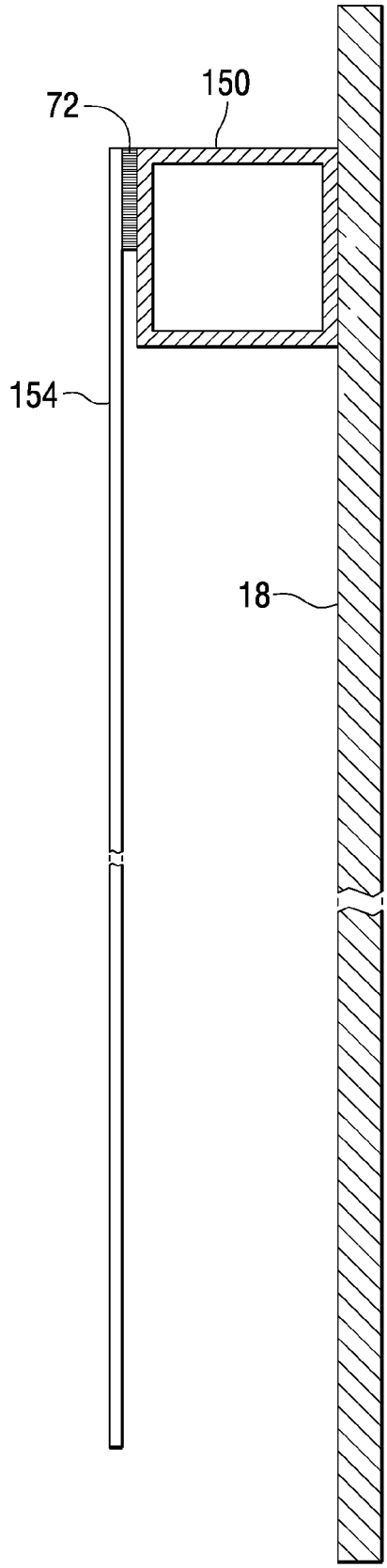
FIG. 8 illustrates an alternative embodiment of a screen enclosure privacy system according to the teachings of the present invention.

In yet another embodiment illustrated in FIG. 8, a beam 150 (e.g., having a cross section of one inch wide and two inches high and fabricated from aluminum) is affixed (using self-tapping screws, for example) to the vertical members 18 of the screen enclosure at a plurality of equal-height locations. Typically the height of the beam 150 is governed by a width of the privacy screen (or curtain) to ensue that a bottom surface of the privacy screen extends to or near the deck surface. Alternatively, the height of the beam 150 can be selected by the user and the width of the privacy screen determined accordingly. One component of the hook and loop fastening system 72 is attached to the beam 150 (for example, a two inch wide strip). The other component of the hook and loop system 72 is attached (by sewing for example) to a length of each panel 154 of the privacy screen along an outside-facing upper edge thereof. Individual panels 154 can be easily installed or removed using the hook and loop fastening system 72. The beam 150 can be covered by a fabric trim piece having a length that is the same length as each panel 154. When a panel 154 is removed, a valence of the same length can be attached in place of the panel 154.

The various techniques mentioned above can be used to the adjacent panels together and attach the lower edge of each panel to the lower horizontal member 16 or to the deck enclosed by the screen enclosure. Individual curtain panels can be installed or removed as desired.

The various embodiments described herein can also include tie-backs to gather the privacy screen panels to create a swag for a more decorative appearance.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments as set forth herein. In addition, modifications may be made to adapt the teachings of the present invention to a particular application without departing from its essential scope. Therefore, it is intended that the invention not be limited to the particular embodiment disclosed as the best mode contemplated for carrying out this invention nor to the other embodiments described and/or illustrated, but that the invention will include all embodiments falling within the scope of the appended claims.

What is claimed is:

1. A privacy system for attaching to an existing screen enclosure enclosing an area where privacy is desired, the screen enclosure including vertical members attached between upper and lower horizontal members to form a screen enclosure frame, the screen enclosure further comprising a screen attached to the upper and lower horizontal members and to the vertical members, the lower horizontal members attached to a surface, the screen enclosure defining an interior region, the privacy system comprising:

a support member for attaching to the vertical members of the screen enclosure, the support member having a substantially horizontal orientation;

a channel along a lower surface of the support member, the channel comprising stop elements at open ends of the channel;

a plurality of fasteners each having a first end slidably engaged within the channel and a second end oppositely disposed relative to the first end, the stop elements cooperating with the channel to retain fasteners within the channel;

a privacy screen extending downwardly from a plurality of the second ends;

a valence affixed to a surface of the support member, the surface of the support member facing toward the interior region;

illumination devices attached to the lower surface of the support member between the valence and the privacy screen; and a first member attached to a lower region of the privacy screen, the first member releasably affixed to a second member, the second member for attaching to a lower region of the vertical member of the screen enclosure, or for attaching to the lower horizontal member of the screen enclosure or for attaching to a region of the surface, wherein the first member comprises a hook and loop fastener band further comprising a hook portion serially oriented relative to a loop portion, one of the hook and the loop portions attached to a lower region of the privacy screen, the other of the hook and the loop portions extending from the lower region of the privacy screen, and wherein the second member comprises a cleat, and wherein one of the hook and the loop portions passes through an opening defined by the cleat and attaches to the other of the hook and the loop portions.

2. The privacy system of claim 1 wherein the privacy screen comprises a non-reflective opaque material.

3. The privacy system of claim 2 wherein the opaque material comprises canvas or boat canvas.

4. The privacy system of claim 2 wherein the opaque material comprises graphical images on at least one surface of the opaque material.

5. The privacy system of claim 1 further comprising a bracket having a first leg attached to a first surface of the support member and a second leg for attaching to an inwardly-facing surface of one of the vertical members, the bracket for attaching the support member to the screen enclosure.

6. The privacy system of claim 5 further comprising a plurality of spaced apart self-tapping screws attaching the support member to the bracket and for attaching the bracket to one of the vertical members.

7. The privacy system of claim 5 wherein the first surface of the support member comprises an upper surface or a lower surface.

8. The privacy system of claim 1 further comprising a plurality of hooks, a first end of each hook supported by the second end of each one the plurality of fasteners and a second end of each hook passing through an opening defined in the privacy screen.

9. The privacy system of claim 1 further comprising a plurality of spaced apart clips attached to the lower surface of the support member for supporting a serial string of the illumination devices.

10. The privacy system of claim 1 further comprising a vertical support surface for releasably receiving a vertical end region of the privacy screen, the vertical support surface comprising a vertical member of the screen enclosure frame or a vertical surface of a structure to which the screen enclosure is attached, a first support component attached to the vertical surface or attached to the vertical member and a second support component attached to the vertical end region of the privacy screen, and wherein engaging the first and the second support components releasably affixes the vertical support surface to the vertical end region of the privacy screen.

11. The privacy system of claim 1 wherein the privacy screen comprises a plurality of privacy screen panels disposed in an end-to-end relation and further comprising an attachment mechanism for releasably attaching an end region of a privacy screen panel to an end region of an adjacent privacy screen panel.

12. A privacy system for attaching to an existing screen enclosure enclosing an area where privacy is desired, the screen enclosure including vertical members attached between upper and lower horizontal members to form a screen enclosure frame, the screen enclosure further comprising a screen attached to the upper and lower horizontal members and the vertical members, the lower horizontal members attached to a surface, the screen enclosure defining an interior region, the privacy system comprising:

a privacy screen;

a support member for attaching to the vertical members of the screen enclosure, the support member having a substantially horizontal orientation;

a first component of a hook and loop fastener system affixed to a surface of the support member, the surface facing toward the interior region;

a second component of the hook and loop fastener system affixed to an upper region of the privacy screen, the upper region of the privacy screen facing away from the interior region, wherein mating the first and the second components positions the privacy screen to provide privacy for users within the interior region; and a vertical support surface of the screen enclosure for releasably affixing to a vertical end region of the privacy screen, the vertical support surface comprising a vertical member of the screen enclosure frame or a vertical surface of a structure to which the screen enclosure is attached, a first support component attached to the vertical support surface and a second support component attached to vertical end regions of the privacy screen, wherein engaging the first and the second support components releasably affixes the vertical support surface to the vertical end region of the privacy screen; and a first member attached to a lower region of the privacy screen, the first member releasably affixed to a second member, the second member for attaching to a lower region of the vertical member of the screen enclosure, or for attaching to the lower horizontal member of the screen enclosure or for attaching to a region of the surface, wherein the first member comprises a hook and loop fastener band further comprising a hook portion serially oriented relative to a loop portion, one of the hook and the loop portions attached to a lower region of the privacy screen, the other of the hook and the loop portions extending from the lower region of the privacy screen, and wherein the second member comprises a cleat, and wherein one of the hook and the loop portions passes through an opening defined by the cleat and attaches to the other of the hook and the loop portions.

13. The privacy screen of claim 12 wherein the privacy screen comprises a plurality of privacy screen panels disposed in an end-to-end relation and an attachment mechanism for releasably attaching an end region of a privacy screen panel to an end region of an adjacent privacy screen panel.

14. The privacy system of claim 12 wherein the privacy screen comprises a non-reflective opaque material, and wherein the opaque material comprises canvas or boat canvas.

15. The privacy system of claim 14 wherein the opaque material comprises graphical images on at least one surface of the opaque material.

16. The privacy system of claim 12 further comprising a first member for attaching to a lower region of the privacy screen, the first member releasably affixed to a second member, the second member attached to a lower region of the vertical member, or attached to a lower horizontal member proximate a lower edge of the privacy screen or attached to a surface region proximate the lower edge of the privacy screen.

* * * * *